US006439217B1

(12) United States Patent
Shih

(10) Patent No.: US 6,439,217 B1
(45) Date of Patent: Aug. 27, 2002

(54) PAINTBALL GUN

(76) Inventor: Pao-Tung Shih, P.O. Box 90, Tainan City (TW)

( * ) Notice: Subject to any disclaimer, the term of this patent is extended or adjusted under 35 U.S.C. 154(b) by 0 days.

(21) Appl. No.: 09/975,013

(22) Filed: Oct. 12, 2001

(51) Int. Cl.[7] ..... F41B 11/00

(52) U.S. Cl. ..... 124/77; 124/70; 124/71; 124/72; 124/73; 124/74; 124/75; 124/76; 42/69.01; 42/69.02

(58) Field of Search ..... 124/70, 71, 72, 124/73, 74, 75, 76, 77; 42/69.01, 69.02, 69.03

(56) References Cited

U.S. PATENT DOCUMENTS 2,673,557 A * 3/1954 Sherman et al. ..... 124/69
3,177,863 A * 4/1965 Spack ..... 124/74
3,680,540 A * 8/1972 Stengl ..... 124/50
4,722,148 A * 2/1988 Walker ..... 42/40
5,052,141 A * 10/1991 Sammons ..... 42/69.01
5,105,569 A * 4/1992 Straitiff ..... 42/2
5,462,042 A * 10/1995 Greenwell ..... 124/56
5,664,552 A * 9/1997 Kunimoto ..... 124/73
5,974,611 A * 11/1999 Casella ..... 124/56

* cited by examiner

*Primary Examiner*—Charles T. Jordan
*Assistant Examiner*—Stephen A Holzen

(57) ABSTRACT

A paintball gun in the present invention is provided with a screw hole formed in a back of a grip and extended through a chamber for being screwed with an adjusting screw whose inner end is protruded into the chamber and pressed against one sidewall surface of a magnetic-attraction plate, by which the adjusting screw is capable of being adjusted to make an inner end of the adjusting screw push the magnetic-attraction plate slightly forward or backward so that a lower end of a locking member is pushed by an outer end of a push rod of the magnetic-attraction plate to adjust the displacement height of the locking member for being fitted with different types of said gun bodies, and thus a single said grip is suited for being assembled with a gun body of different style to decrease the manufacturing of gun bodies with varied styles and lower the production cost.

2 Claims, 5 Drawing Sheets

PAINTBALL GUN

BACKGROUND OF THE INVENTION

1. Field of the Invention

This invention relates to a paintball gun, particularly to one capable of adjusting an adjusting screw disposed in a back of a grip to make an inner end of the adjusting screw push a magnetic-attraction plate slightly forward or backward so as to adjust the displacement height of a locking member for being fitted with different types of gun bodies, by which a single grip is suited for being assembled with a gun body of different style to decrease the manufacturing of gun bodies with varied styles and lower the production cost.

2. Description of the Prior Art

A known conventional paintball gun, as shown in FIG. 1, mainly includes a grip 1 and a gun body 2. A recess 10 is disposed inside the grip 1 and provided with a circuit board 11 and an electromagnet 12 therein. A chamber 13 disposed above the recess 10 and communicated with the recess 10 is provided with an electromagnetic valve 14 therein. A magnetic-attraction plate 15 disposed at one side of the electromagnetic valve 14 has a push rod 150 extended through the electromagnetic valve 14 and protruded from the other side of the electromagnetic valve 14. A locking member 16 pivoted on an upper portion of the grip 1 has an upper end whose bottom is urged upward by a spring 17 disposed below and a lower end pushed against by an outer end of the push rod 150. A trigger 18 disposed in front of the grip 1 has an actuator 19 located in back of the trigger 18. The grip I is fixed beneath the gun body 2. The gun body 2 has a slide way 20 disposed at a bottom of the gun body 2 for accommodating the upper end of the locking member 16, an air chamber 21 provided with a recoil rod 22 therein. A locking groove 23 is formed at a bottom of the recoil rod 22 for firmly engaging the locking member 16. A firing chamber 24 located above the air chamber 21 has a pull rod 25 disposed at a rear of the firing chamber 24 and provided with a linking rod 26 connected with the recoil rod 22, by which a pull of the pull rod 25 will make the recoil rod 22 moved accordingly.

However, the known conventional paintball gun has the locking member 16 of the grip 1 with a fixed height in its engaging position hard to be make any adjustment, which is only suited for being combined with one specific gun body 2. In case of being combined with a different gun body 2, a fitted grip 1 is required and thus greatly increases the production cost.

SUMMARY OF THE INVENTION

The main purpose of the invention is to offer a paintball gun capable of having a single grip suited for being assembled with a gun body of different style.

The main feature of the invention is to provide a paintball gun having a screw hole formed in a back of a grip and extended through a chamber for being screwed with an adjusting screw whose inner end is protruded into the chamber and pressed against one sidewall surface of a magnetic-attraction plate.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
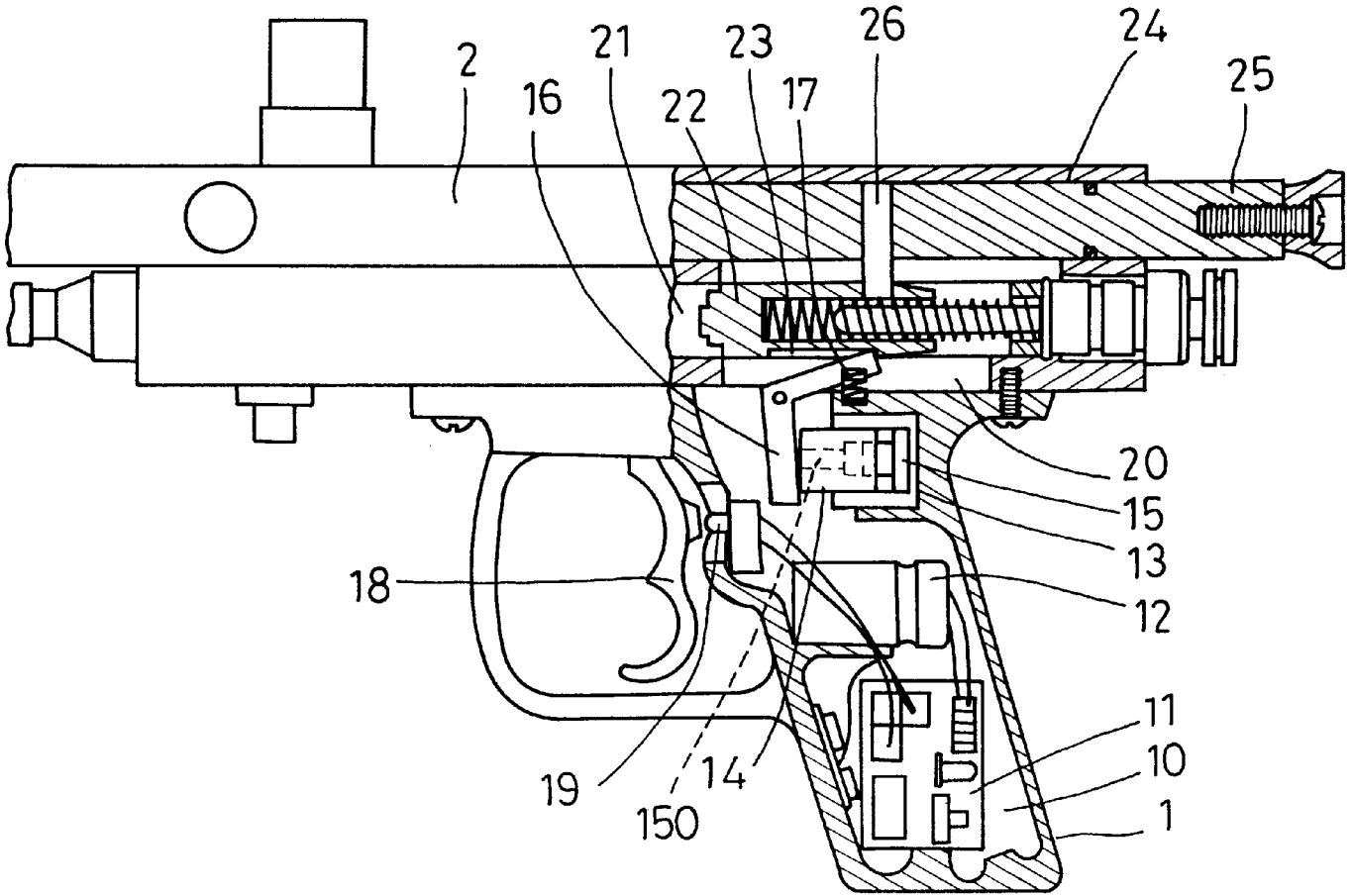
FIG.1 (PRIOR ART)
FIG. 1 is a schematic view of a known conventional paintball gun.
Figure 2:
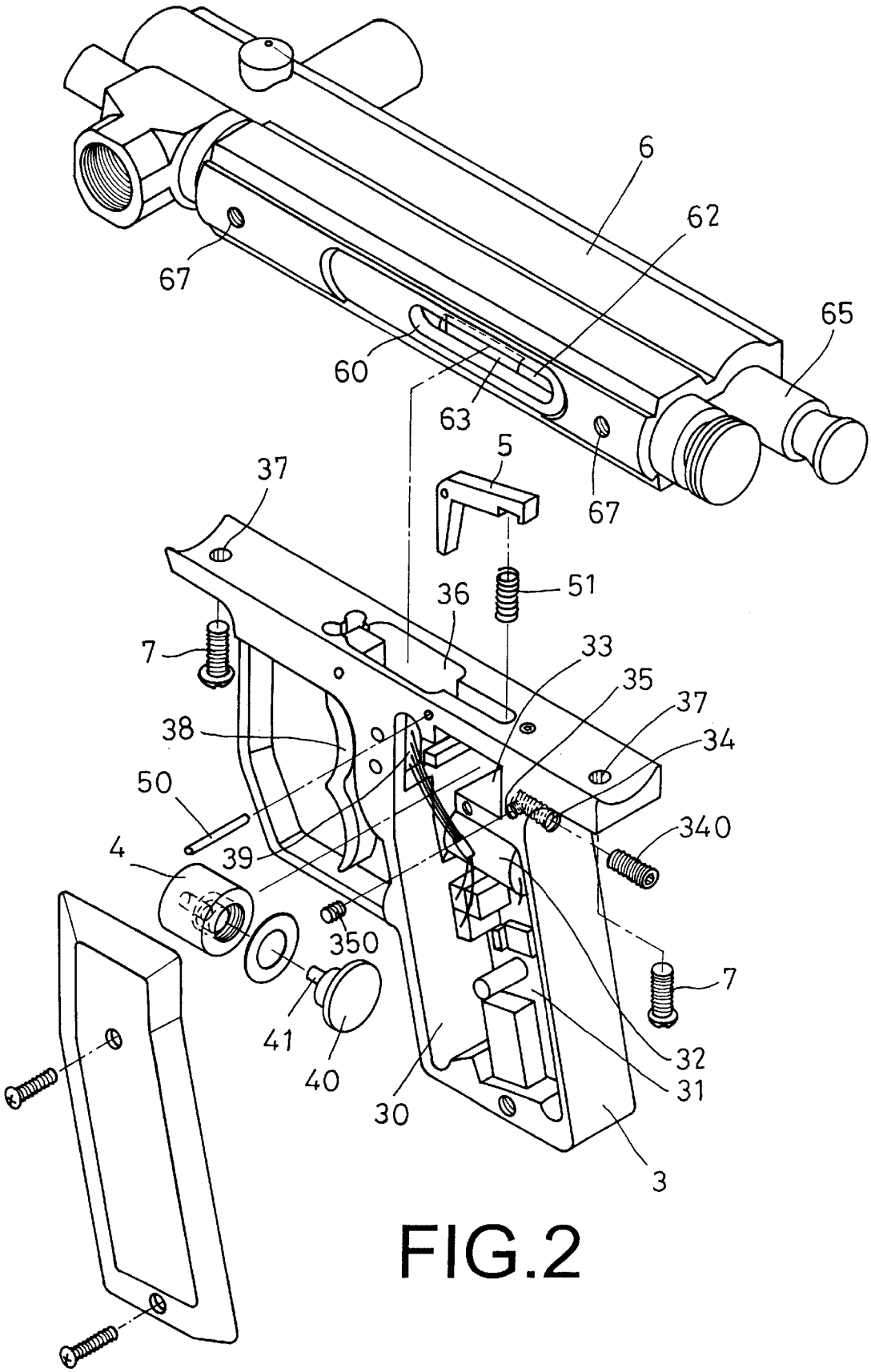
FIG. 2 is an exploded perspective view of a paintball gun in the present invention.
Figure 3:
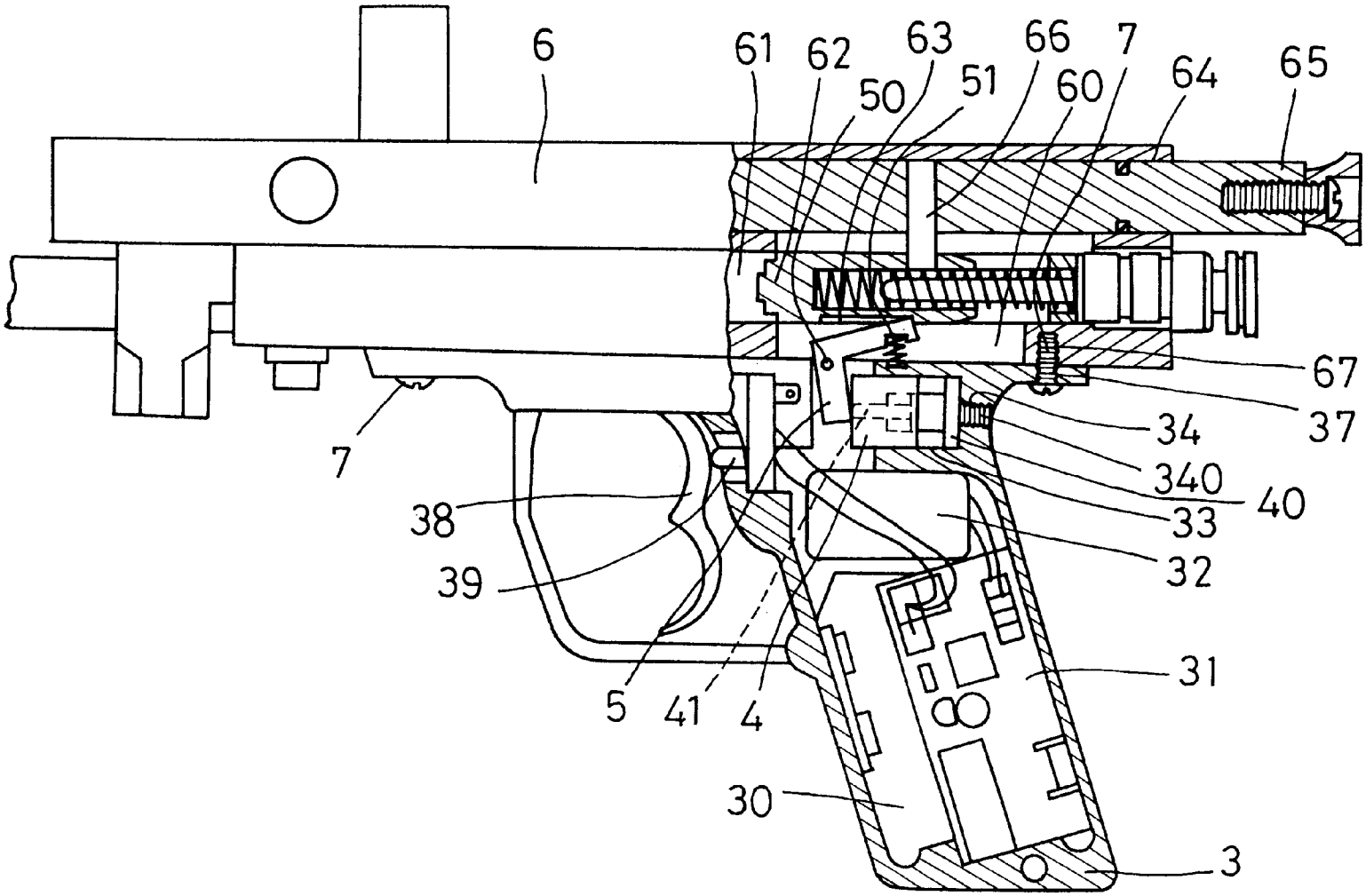
FIG. 3 is a cross-sectional view of the paintball gun in the present invention.

A first preferred embodiment of a paintball gun in the present invention, as shown in FIGS. 2 and 3, mainly includes a grip 3 and a gun body 6. A recess 30 is disposed inside the grip 3 and provided with a circuit board 31 and an electromagnet 32 therein. A chamber 33 is disposed above the recess 30 and communicated with the recess 30. A screw hole 34 formed in a back of the grip 3 and extended through the chamber 33 is capable of being screwed with an adjusting screw 340 whose inner end is protruded into the chamber 33. A setscrew hole 35 formed in one sidewall surface of the grip 3 and communicated with the screw hole 34 is capable of being screwed with a setscrew 350 whose inner end is capable of being pressed against the adjusting screw 340 to keep the adjusting screw 340 in a fixed position. A through groove 36 formed in a top surface of the grip 3 and communicated with the chamber 33. Two through holes 37 is each respectively formed in a front end and a rear end of the top surface of the grip 3. A trigger 38 disposed in front of the grip 3 has an actuator 39 located in back of the trigger 38.

An electromagnetic valve 4 disposed inside the chamber 33 of the rip 3 is provided with a magnetic-attraction plate 40 at one side of the electromagnetic valve 4. The magnetic-attraction plate 40 has a push rod 41 disposed at one sidewall of the magnetic-attraction plate 40, extended through the electromagnetic valve 4 and protruded from the other side of the electromagnetic valve 4. Moreover, an inner end of the adjusting screw 340 is capable of being pressed against the other sidewall surface of the magnetic-attraction plate 40.

A locking member 5 is pivoted by a pivot 50 and disposed in the through groove 36 on the top surface of the grip 3. The locking member 5 has an upper end whose top is protruded from the top surface of the grip 3 as well as whose bottom is urged upward by a spring 51 disposed below and a lower end pressed against by an outer end of the push rod 41.

The gun body 6 fixed on the grip 3 has a slide way 60 disposed at a bottom of the gun body 6 for accommodating the upper end of the locking member 5, an air chamber 61 provided with a recoil rod 62 therein. A locking groove 63 is formed at a bottom of the recoil rod 62 for firmly engaging the locking member 5. A firing chamber 64 located above the air chamber 61 has a pull rod 65 disposed at a rear of the firing chamber 64 and provided with a linking rod 66 connected with the recoil rod 62, by which a pull of the pull rod 25 will make the recoil rod 62 moved accordingly. Moreover, there are two screw holes 67 formed in the bottom surface of the gun body 6.

The two screw members 7 is extended through the two through holes 37 of the grip 3 and screwed into the two screw holes 67 of the gun body 6 so as to firmly combine the grip 3 and the gun body 6 together.

Figure 4:
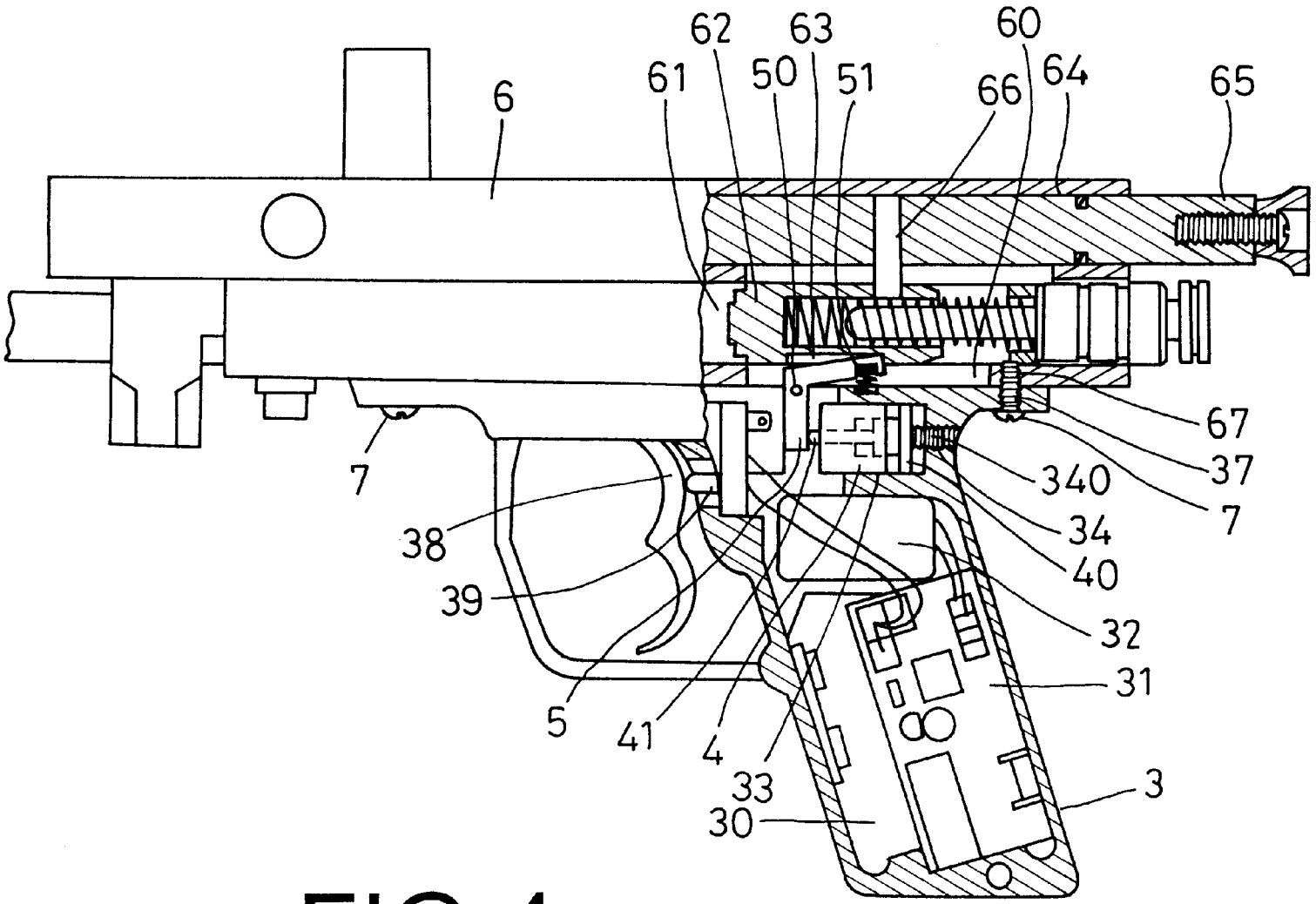
FIG. 4 is a schematic view of the paintball gun in the present invention, showing an adjustment in the displacement height of a locking member; and, FIG. 5 is a schematic view of the paintball gun in the present invention, showing the paintball gun being in a fired status.

In assembling, referring to FIGS. 3 and 4, when the grip 3 is to be assembled with a different gun body 6, firstly release the setscrew 350 until the setscrew 350 is not pressed against the adjusting screw 340, by which the adjusting screw 340 is capable of being screwed inward or outward. When the adjusting screw 340 is screwed inward toward the electromagnetic valve 4, the magnetic-attraction plate 40 can be pushed by the inner end of the adjusting screw 340 close to the electromagnetic valve 4 to shorten the distance between the magnetic-attraction plate 40 and the electromagnetic valve 4. Following the inward movement of the magnetic-attraction plate 40, the push rod 41 is moved inward accordingly, by which the lower end of the locking member 5 is pushed outward under the protruding of the outer end of the push rod 41 so as to be away from the electromagnetic valve 4. Meanwhile, the upper end of the locking member 5 with the pivot 50 as the axis will be rotated downward to compress the spring 51 disposed below, by which the height of the upper end of the locking member 5 is lowered. On the contrary, when the adjusting screw 340 is screwed outward, the upper end of the locking member 5 will be moved upward under the upward urging of the spring 51 disposed below. Meanwhile, the lower end of the locking member 5 with the pivot 50 as the axis will be rotated toward the electromagnetic valve 4 to push the push rod 41 to be moved into the electromagnetic valve 4, by which the magnetic-attraction plate 40 can be moved outward accordingly and pressed against the inner end of the adjusting screw 340 so as to enlarge the distance between the magnetic-attraction plate 40 and the electromagnetic valve 4 and to heighten the height of the upper end of the locking member 5. After the adjusting screw 340 is adjusted to a required position, the setscrew 350 is screwed tightly so that the adjusting screw 340 can be kept in the fixed position. With the adjustment of the adjusting screw 340, the magnetic-attraction plate 40 and the push rod 41 can be pushed and moved by the inner end of the adjusting screw 340 to adjust the displacement height of the upper end of the locking member 5 for being fitted with a locking groove 63 of a different gun body 6 with a different depth so that the grip 3 can be combined with a different type of gun body 6, by which a single grip 3 is suited for being assembled with a gun body 6 of different style to decrease the manufacturing of gun bodies 6 with varied styles, to lower the production cost and to provide an easy assembly.

Figure 5:
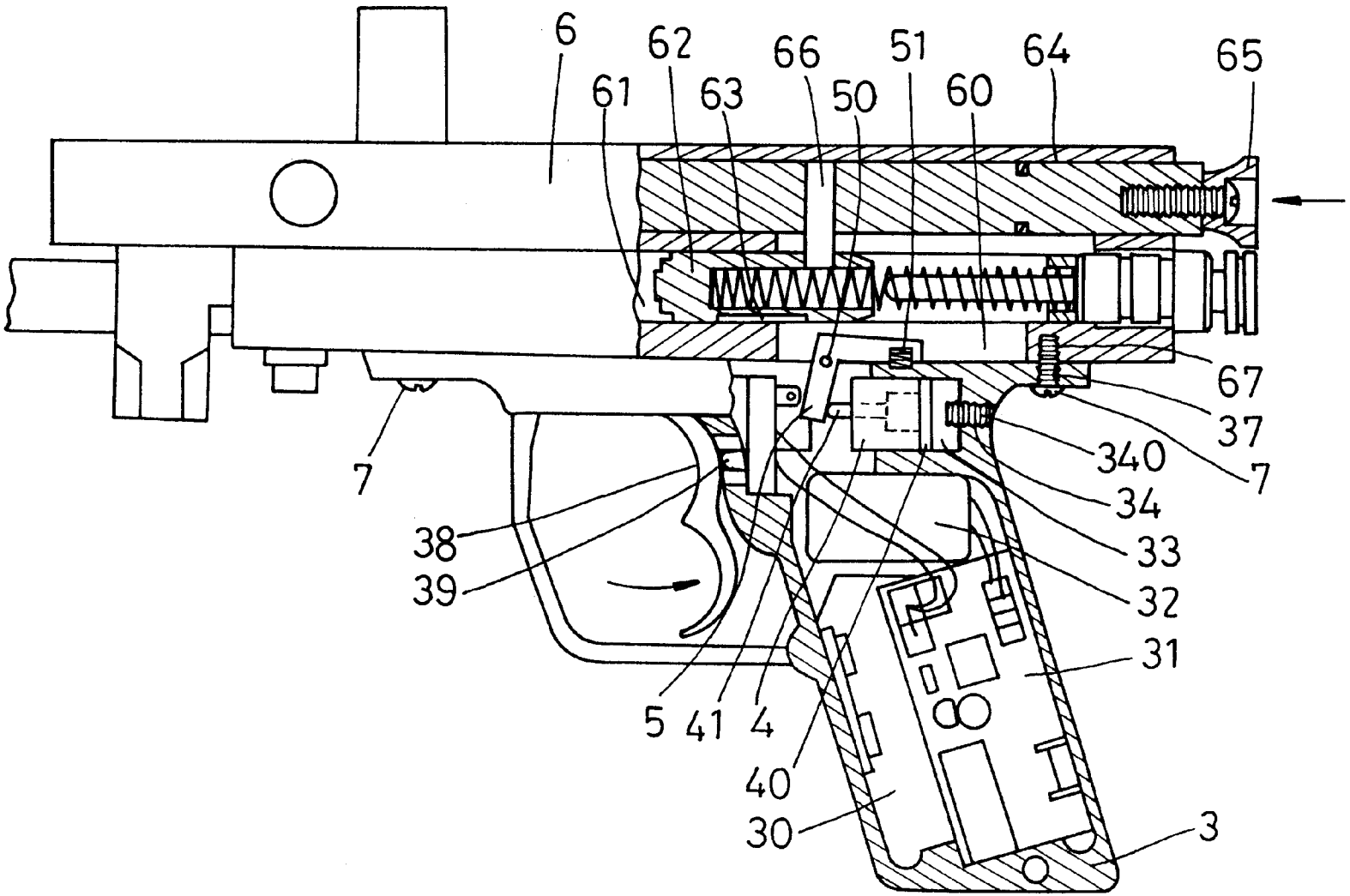

In using, referring to FIG. 5, when the trigger 38 is pressed to actuate the actuator 39, the circuit is closed so that the electromagnetic valve 4 will have magnetic force to attract the magnetic-attraction plate 40 to be attached against the sidewall of the electromagnetic valve 4, by which the lower end of the locking member 5 is pushed outward under the protruding of the outer end of the push rod 41 so as to be away from the electromagnetic valve 4. Meanwhile, the upper end of the locking member 5 with the pivot 50 as the axis will be rotated downward to compress the spring 51 disposed below to be in an elastically compressed status, by which the upper end of the locking member 5 is lowered and freed from the engagement of the locking grooves 63 of the recoil rod 62 so as to allow paintballs to be fired off. After the firing of the paintballs, release the trigger 38 to have the circuit in an open status. And then, pull the pull rod 65 outward to make the recoil rod 62 moved accordingly so that the upper end of the locking member 5 can be engaged in the locking grooves 63 again and the paintballs will be fired off once the trigger 38 is pressed.

While the preferred embodiment of the invention has been described above, it will be recognized and understood that various modifications may be made therein and the appended claims are intended to cover all such modifications that may fall within the spirit and scope of the invention.

What is claimed is:

1. A paintball gun mainly combined by a grip and a gun body comprising:

said grip having a recess disposed inside said grip and provided with a circuit board and an electromagnet therein, a chamber disposed above said recess and communicated with said recess, a through groove formed in a top surface of said grip and communicated with said chamber, two through holes each respectively formed in a front end and a rear end of said top surface of said grip, as well as a trigger disposed in front of said grip and having an actuator located in back of said trigger;

an electromagnetic valve disposed inside said chamber of said grip and provided with a magnetic-attraction plate at one side of said electromagnetic valve, said magnetic-attraction plate having a push rod extended through said electromagnetic valve and protruded from the other side of said electromagnetic valve;

a locking member pivoted by a pivot and disposed in said through groove formed on said top surface of said grip, said locking member having an upper end whose top is protruded from said top surface of said grip as well as whose bottom is urged upward by a spring disposed below and a lower end pressed against by an outer end of said push rod;

said gun body fixed on said grip with screw members;

characterized by a screw hole formed in a back of said grip and extended through said chamber for being screwed with an adjusting screw whose inner end is protruded into said chamber and pressed against one sidewall surface of said magnetic-attraction plate; and, whereby said adjusting screw disposed in said back of said grip is capable of being adjusted to make an inner end of said adjusting screw push said magnetic-attraction plate slightly forward or backward so that said lower end of said locking member is pushed by said outer end of said push rod of said magnetic-attraction plate to adjust the displacement height of said locking member for being fitted with different types of said gun bodies and thus a single said grip is suited for being assembled with a gun body of different style to decrease the manufacturing of said gun bodies with varied styles and lower the production cost.

2. The paintball gun as claimed in claim 1, wherein a setscrew hole formed in one sidewall surface of said grip and communicated with said screw hole is capable of being screwed with a setscrew whose inner end is pressed against said adjusting screw to keep said adjusting screw in a fixed position.

* * * * *